US009027165B2

(12) United States Patent
Cunningham

(10) Patent No.: US 9,027,165 B2
(45) Date of Patent: May 12, 2015

(54) HAT SYSTEMS

(76) Inventor: Paul David Cunningham, Yuma, AZ (US)

( * ) Notice: Subject to any disclaimer, the term of this patent is extended or adjusted under 35 U.S.C. 154(b) by 408 days.

(21) Appl. No.: 13/210,273

(22) Filed: Aug. 15, 2011

(65) Prior Publication Data

US 2013/0298309 A1 Nov. 14, 2013

Related U.S. Application Data

(60) Provisional application No. 61/382,393, filed on Sep. 13, 2010, provisional application No. 61/422,584, filed on Dec. 13, 2010.

(51) Int. Cl.
*A42B 1/24* (2006.01)
*A42B 1/06* (2006.01)

(52) U.S. Cl.
CPC ..... *A42B 1/247* (2013.01); *A42B 1/062* (2013.01)

(58) Field of Classification Search
CPC ..... A42B 1/004; A42B 1/062; A42B 1/064; A42B 1/066; A42B 1/067; A42B 1/068; A42B 1/18; A42B 1/24; A42B 1/247
USPC ..... 2/6.2, 6.3, 6.7, 421, 10, 173.5, 209.13, 2/209.14, 209.3, 175.5, 175.6, 175.7, 2/195.3, 195.4, 195.6, 175.1; D2/882
See application file for complete search history.

(56) References Cited

U.S. PATENT DOCUMENTS 264,574 A * 9/1882 Shone ..... 351/155
2,691,164 A * 10/1954 Feldman ..... 2/10
3,703,750 A * 11/1972 Irwin, Jr. ..... 24/265 R
3,781,915 A * 1/1974 Menold et al. ..... 2/10
4,179,753 A * 12/1979 Aronberg et al. ..... 2/10
4,304,005 A * 12/1981 Danley, Sr. ..... 2/10
4,839,926 A * 6/1989 Choi ..... 2/10
5,347,655 A * 9/1994 Garrett ..... 2/10
5,406,645 A * 4/1995 Lin ..... 2/10
5,457,821 A * 10/1995 Kiefer ..... 2/195.1
5,623,732 A * 4/1997 Olajide, Jr. ..... 2/195.1
5,694,647 A * 12/1997 Crickmore ..... 2/172
5,815,831 A * 10/1998 De Wan ..... 2/10
5,826,271 A 10/1998 Garrett
5,901,371 A * 5/1999 Lee ..... 2/10
5,937,439 A * 8/1999 Barthold et al. ..... 2/10
5,940,891 A * 8/1999 Lane ..... 2/426
5,987,640 A * 11/1999 Ryder ..... 2/10

(Continued)

FOREIGN PATENT DOCUMENTS

KR 2020000021409 U 12/2000
KR 2020010251859 Y1 11/2001

*Primary Examiner* — Alissa L Hoey
(74) *Attorney, Agent, or Firm* — Lodestar Patents, PLLC; Raymond J. E. Hall

(57) ABSTRACT

A hat system relating to reducing and/or eliminating physical interferences between hat bills and eyewear rims by the introduction of strategic hat bill cutouts along the periphery of the bill as a means for providing additional physical clearance for user-chosen eyewear. Additionally, users of the preferred hat system may also take advantage of bill cutouts as a means to secure eyewear on the face during sports, or other moments of high activity. Further, the hat system incorporates a camouflage covering to camouflage such strategic hat bill cutouts. Even further, the hat system provides unique design elements provided by geometrically-shaped bill cutouts in combination with, or without, coverings.

10 Claims, 6 Drawing Sheets

(56) References Cited

U.S. PATENT DOCUMENTS

| | | | | |
|---|---|---|---|---|
| 6,049,904 | A * | 4/2000 | Siracusa | 2/4 |
| 6,185,748 | B1 * | 2/2001 | DeChambeau | 2/195.1 |
| 6,237,159 | B1 | 5/2001 | Martin | |
| 6,247,177 | B1 | 6/2001 | Hayes | |
| D444,292 | S * | 7/2001 | Wang | D2/882 |
| 6,282,721 | B1 * | 9/2001 | Travalgia | 2/171 |
| 6,298,495 | B1 * | 10/2001 | Totani | 2/209.13 |
| D451,532 | S | 12/2001 | Bondy | |
| D455,538 | S * | 4/2002 | Rhoden | D2/882 |
| 6,397,396 | B1 * | 6/2002 | Vibert | 2/209.13 |
| 6,644,807 | B1 * | 11/2003 | Hood | 351/155 |
| 6,647,554 | B1 * | 11/2003 | Yan | 2/209.13 |
| 6,662,371 | B2 | 12/2003 | Shin | |
| 6,668,426 | B1 * | 12/2003 | Morris | 24/3.3 |
| 6,671,885 | B2 * | 1/2004 | Viggiano | 2/209.13 |
| 6,711,744 | B1 | 3/2004 | Hockenbury | |
| 6,739,718 | B1 | 5/2004 | Jung | |
| 6,745,395 | B2 * | 6/2004 | Noble | 2/12 |
| 6,792,619 | B1 * | 9/2004 | Morris et al. | 2/10 |
| 6,944,882 | B2 * | 9/2005 | Lawrence et al. | 2/13 |
| 7,013,491 | B2 * | 3/2006 | Ferrara | 2/209.13 |
| 7,051,406 | B1 * | 5/2006 | Morris et al. | 24/3.12 |
| 7,165,273 | B1 | 1/2007 | Redmond | |
| 7,178,278 | B1 * | 2/2007 | Morris | 40/329 |
| 7,229,172 | B2 * | 6/2007 | Presswood et al. | 351/155 |
| D547,531 | S | 7/2007 | Wilson et al. | |
| 7,255,436 | B2 * | 8/2007 | Tracy | 351/155 |
| 7,275,270 | B2 * | 10/2007 | Cotutsca | 2/209.13 |
| D557,881 | S * | 12/2007 | Saveliev | D2/893 |
| D571,539 | S * | 6/2008 | Valcourt | D2/866 |
| D584,031 | S * | 1/2009 | Grandfield | D2/882 |
| 7,484,845 | B2 * | 2/2009 | Douglas | 351/155 |
| 7,673,349 | B2 * | 3/2010 | Romanski et al. | 2/209.13 |
| 7,707,657 | B2 * | 5/2010 | Kim | 2/209.12 |
| 7,866,813 | B2 * | 1/2011 | Anhalt | 351/155 |
| 7,904,970 | B2 * | 3/2011 | Thomas | 2/209.13 |
| 7,979,920 | B2 * | 7/2011 | Gilman | 2/195.1 |
| 8,286,269 | B2 * | 10/2012 | Springer et al. | 2/422 |
| D684,754 | S * | 6/2013 | Kim | D2/882 |
| 2003/0024033 | A1 * | 2/2003 | Viggiano | 2/209.13 |
| 2003/0106134 | A1 * | 6/2003 | Kim | 2/171 |
| 2005/0039240 | A1 * | 2/2005 | Kidouchim | 2/10 |
| 2006/0152671 | A1 * | 7/2006 | Risso et al. | 351/155 |
| 2006/0268221 | A1 * | 11/2006 | Tracy | 351/155 |
| 2007/0028360 | A1 * | 2/2007 | Cotutsca | 2/209.13 |
| 2007/0079422 | A1 * | 4/2007 | Wu | 2/171 |
| 2007/0101480 | A1 * | 5/2007 | Douglas | 2/209.13 |
| 2007/0229759 | A1 | 10/2007 | Jones | |
| 2007/0256214 | A1 * | 11/2007 | Mcgowan et al. | 2/209.13 |
| 2008/0028498 | A1 * | 2/2008 | Beheton | 2/175.1 |
| 2009/0038045 | A1 * | 2/2009 | Wang | 2/10 |
| 2009/0056000 | A1 * | 3/2009 | de Taboada | 2/422 |
| 2009/0229028 | A1 * | 9/2009 | Dobkins | 2/10 |
| 2009/0235437 | A1 * | 9/2009 | Springer et al. | 2/422 |
| 2010/0014046 | A1 | 1/2010 | Millios | |
| 2010/0095977 | A1 * | 4/2010 | Schmitz et al. | 132/275 |
| 2010/0212066 | A1 * | 8/2010 | Gilman | 2/209.13 |
| 2010/0212067 | A1 * | 8/2010 | Thomas | 2/209.13 |
| 2011/0088144 | A1 * | 4/2011 | Thomas | 2/209.13 |
| 2011/0126343 | A1 * | 6/2011 | Tualla et al. | 2/209.13 |
| 2011/0219508 | A1 * | 9/2011 | Hill | 2/10 |
| 2011/0247120 | A1 * | 10/2011 | Knoedler | 2/10 |
| 2011/0314580 | A1 * | 12/2011 | Vach | 2/10 |
| 2012/0096625 | A1 * | 4/2012 | Sarazin | 2/195.1 |
| 2012/0210493 | A1 * | 8/2012 | Evans | 2/209.13 |
| 2013/0111649 | A1 * | 5/2013 | Sirianni | 2/195.1 |

* cited by examiner

HAT SYSTEMS

CROSS-REFERENCE TO RELATED APPLICATION

The present application is related to and claims priority from prior provisional application Ser. No. 61/382,393, filed Sep. 13, 2010, entitled "HAT SYSTEMS"; and, this application is related to and claims priority from prior provisional application Ser. No. 61/422,581, filed Dec. 13, 2010, entitled "HAT SYSTEMS", the contents of all of which are incorporated herein by this reference and are not admitted to be prior art with respect to the present invention by the mention in this cross-reference section.

BACKGROUND OF THE INVENTION

This invention relates to providing a system for improved hat brims. More particularly, this invention relates to providing a system relating to at least a baseball-style hat to more snugly fit adjacent a pair of eyeglasses during wearing of such a hat and such eyeglasses.

Baseball-style caps have a brim portion that is used as a visor to assist a user to shield the eyes from bright lights, including the sun. Other hats are known to have a brim/visor portion to assist a user to shield the eyes from bright lights, including the sun. A problem with adjusting a visor portion of a hat occurs when a visor wearer is also wearing a pair of eyeglasses, more particularly sunglasses. Currently, many baseball-styled hats, as well as other billed hats, cannot be pulled down fully while wearing certain eyewear due to physical obstructions between the hat brim and eyewear rims/lenses. This is particularly a problem for users of hats designed with high bill curvature. In order for a user to relieve physical constraints and accommodate both the billed hat and eyewear, the user may choose to wear billed hats higher on the forehead than desired which may lead to user discomfort and/or reduced light and sun protection. A system is thus needed which will provide billed hat users with an accommodation means for selected eyewear.

Additionally, when one is playing an active sport such as, for example, golf, it is advantageous to have a means to assist keeping a pair of eyeglasses/sunglasses from falling off the head during active movement of the head. It would be useful to have a hat visor portion that could couple with a pair of a user's eyeglasses/sunglasses and assist holding such eyeglasses/sunglasses in place during such active movement.

OBJECTS AND FEATURES OF THE INVENTION

A primary object and feature of the present invention is to provide a system overcoming the above-mentioned problem(s).

It is a further object and feature of the present invention to provide such a system to assist a baseball-style hat visor wearer to more snugly fit the hat visor portion adjacent, and preferably slightly over, a pair of eyeglasses particularly sunglasses, during wearing of such hat and such glasses.

It is a further object and feature of the present invention to provide such a system to have a hat visor portion that will couple with a pair of a user's eyeglasses/sunglasses and assist holding such eyeglasses/sunglasses in place during active movement.

It is a further object and feature of the present invention to provide such a system that combines the above-mentioned functions with a design element; such design element, for example, comprising a logo, trademark, service mark or other unique design element (for example, shark fin) on a brim/visor.

Another object and feature of the present invention is to provide billed hat systems with a built-in accommodation means for eyewear.

It is a further object and feature of the present invention to provide hat systems with adjustable bill-cutouts for providing physical clearance for selected eyewear.

Another primary object and feature of the present invention is to provide hat systems with adjustable bill-cutouts which are adaptable for essentially any billed hat and eyewear combination.

Another object and feature of the present invention is to provide hat systems with adjustable bill-cutouts which may aid in securing eyewear on the face of the user during moments of high activity.

It is a further object and feature of the present invention to provide such a system that combines the above mentioned functions with a camouflage element that offers a means to camouflage at least one of the hat function element(s) on a brim/visor.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a system, relating to permitting at least one wearer to contemporaneously wear headwear brims and eyewear rims occupying at least one co-location, comprising: at least one headwear brim structured and arranged to assist shade-cover to at least one portion of the face of the at least one wearer; wherein such at least one headwear brim comprises at least one accommodator structured and arranged to accommodate at least one portion of the eyewear rims in the at least one co-location; wherein, when the at least one wearer is contemporaneously wearing such at least one headwear brim and the at least one portion of the eyewear rims, such contemporaneous wearing is accommodated; and wherein without such at least one accommodator such at least one headwear brim would interfere with the contemporaneous wearing of the eyewear rims.

Moreover, it provides such a system wherein such at least one accommodator comprises at least one restrainer structured and arranged to restrain at least one portion of the eyewear rims. Additionally, it provides such a system wherein such at least one restrainer is structured and arranged to assist maintaining the eyewear rims on the wearer during wearer physical activity. Also, it provides such a system wherein such at least one restrainer comprises at least two friction-resister elements structured and arranged to assist restraint of the eyewear rims by friction resistance along at least two points along the eyewear rims. In addition, it provides such a system further comprising at least one camouflage element structured and arranged to camouflage such at least one accommodator. And, it provides such a system wherein such at least one accommodator comprises at least two notches, situate opposed along at least one periphery of such at least one headwear brim, structured and arranged to accommodate at least opposed eyewear rim portions. Further, it provides such a system wherein each of such at least two notches resemble at least a shark fin geometry.

Even further, it provides such a system further comprising at least one camouflage element structured and arranged to at least camouflage such at least two notches. Moreover, it provides such a system wherein each of such at least two notches resemble at least a shark fin geometry. Additionally, it provides such a system wherein: such at least one headwear brim comprises an upper portion and a lower portion; and such at least one camouflage element covers at least such upper portion of such at least one headwear brim.

In accordance with another preferred embodiment hereof, this invention provides a system, relating to permitting at least one wearer to contemporaneously wear a visor and eyewear rims occupying at least one co-location, comprising: a visor structured and arranged to provide shade to at least one portion of the face of the at least one wearer; wherein such visor comprises at least two eyewear-rim accommodators structured and arranged to accommodate at least two portions of the eyewear rims in at least one co-location with such visor; and at least one camouflage element structured and arranged to camouflage such at least two eyewear-rim accommodators; wherein without such at least one accommodator such visor would interfere with the contemporaneous wearing of the eyewear rims.

Also, it provides such a system wherein such at least one accommodator comprises at least two notches, situate opposed along at least one periphery of such visor, structured and arranged to accommodate at least two opposed eyewear rim portions. In addition, it provides such a system wherein such at least one camouflage element is structured and arranged to at least camouflage such at least two notches. And, it provides such a system wherein each of such at least two notches resemble at least a shark fin geometry. Further, it provides such a system wherein: such visor comprises an upper portion and a lower portion; and such at least one camouflage element covers at least such upper portion of such visor.

In accordance with another preferred embodiment hereof, this invention provides a system, relating to permitting at least one wearer to contemporaneously wear headwear brims and eyewear rims occupying at least one co-location, comprising: at least one headwear brim structured and arranged to provide shade to at least one portion of the face of the at least one wearer; wherein such at least one headwear brim comprises at least one eyewear-rim accommodator structured and arranged to accommodate at least one portions of the eyewear rims in at least one co-location; at least one camouflage element structured and arranged to camouflage such at least one eyewear-rim accommodator; wherein without such at least one accommodator such at least one headwear brim would interfere with the contemporaneous wearing of the eyewear rims.

Even further, it provides such a system wherein such at least one accommodator comprises at least one restrainer structured and arranged to restrain at least one portion of the eyewear rims. Even further, it provides such a system wherein such at least one restrainer is structured and arranged to assist maintaining the eyewear rims on the wearer during wearer physical activity. Even further, it provides such a system wherein such at least one restrainer comprises at least two friction-resister elements structured and arranged to assist restraint of the eyewear rims by friction resistance along at least two points along the eyewear rims.

In accordance with another preferred embodiment hereof, this invention provides a system, relating to permitting at least one user to contemporaneously wear headwear brims and eyewear rims normally occupying at least one co-location, comprising: headwear-brim means for assisting cover to at least one portion of at least one face of the at least one user; wherein such headwear-brim means comprises accommodator means for accommodating at least one portion of the eyewear rims in the at least one co-location; wherein, when the at least one user is contemporaneously wearing such headwear-brim means and the at least one portion of the eyewear rims, such contemporaneous wearing is accommodated; and wherein without such accommodator means, such headwear-brim means would interfere with the contemporaneous wearing of the eyewear rims. Even further, it provides such a system wherein such accommodator means comprises restrainer means for restraining at least one portion of the at least one eyewear rims. Even further, it provides such a system further comprising camouflage element means for camouflaging such accommodator means.

In accordance with another preferred embodiment hereof, this invention provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
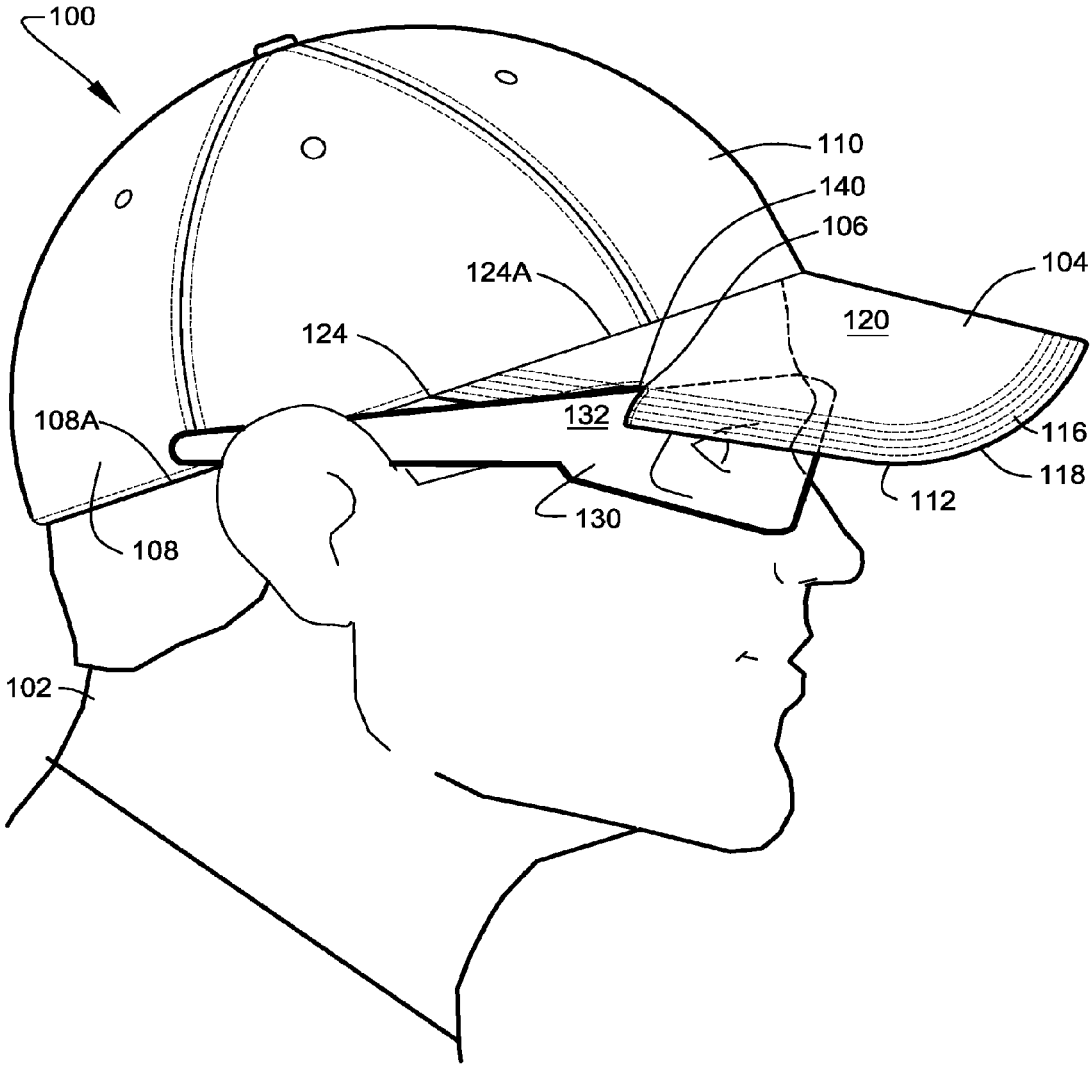
FIG. 1 shows side view, illustrating a billed hat of the hat system in use by a hat wearer, according to a preferred embodiment of the present invention.
Figure 2:
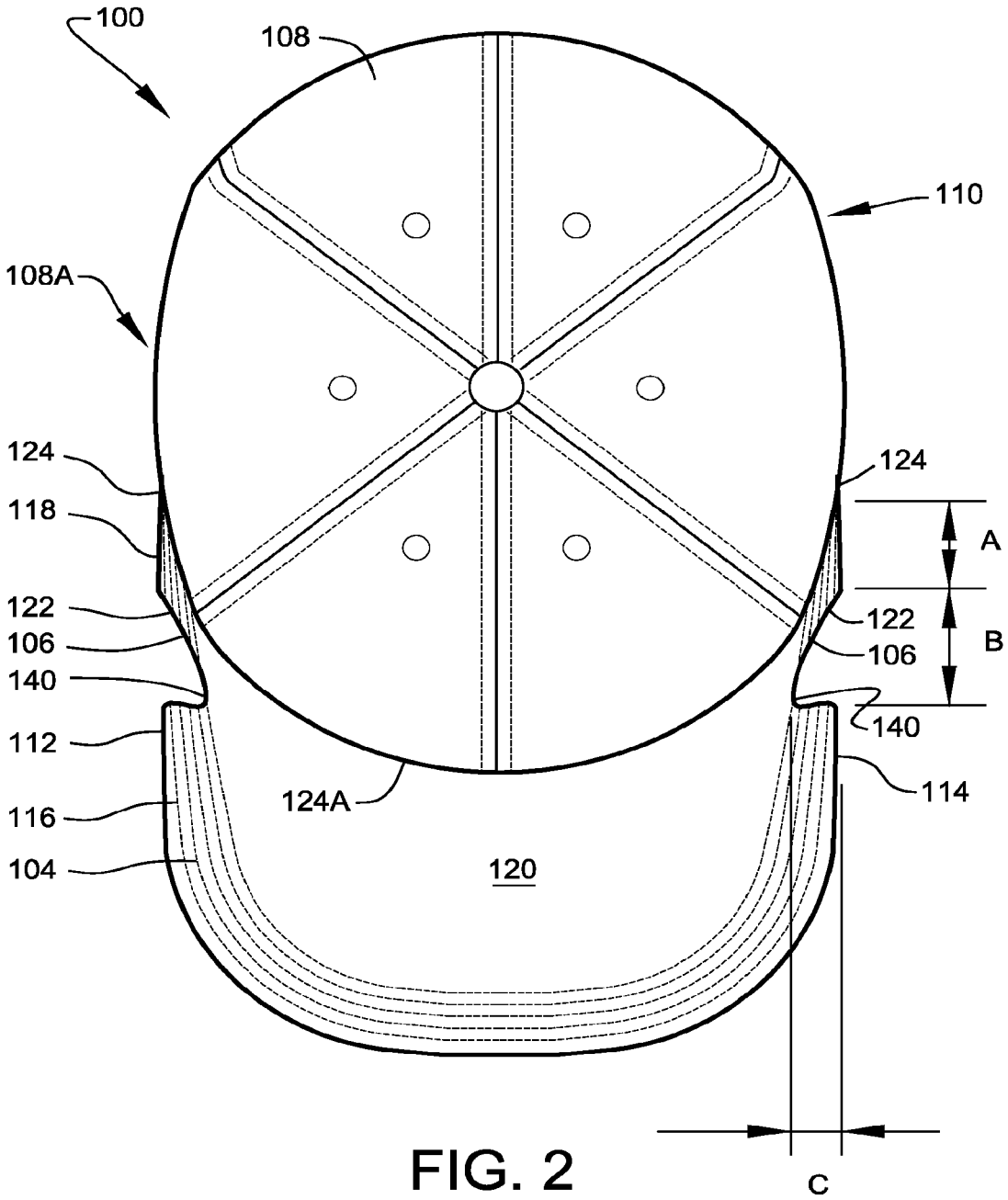
FIG. 2 shows a top view, illustrating the billed hat, according to the preferred embodiment of FIG. 1.
Figure 3:
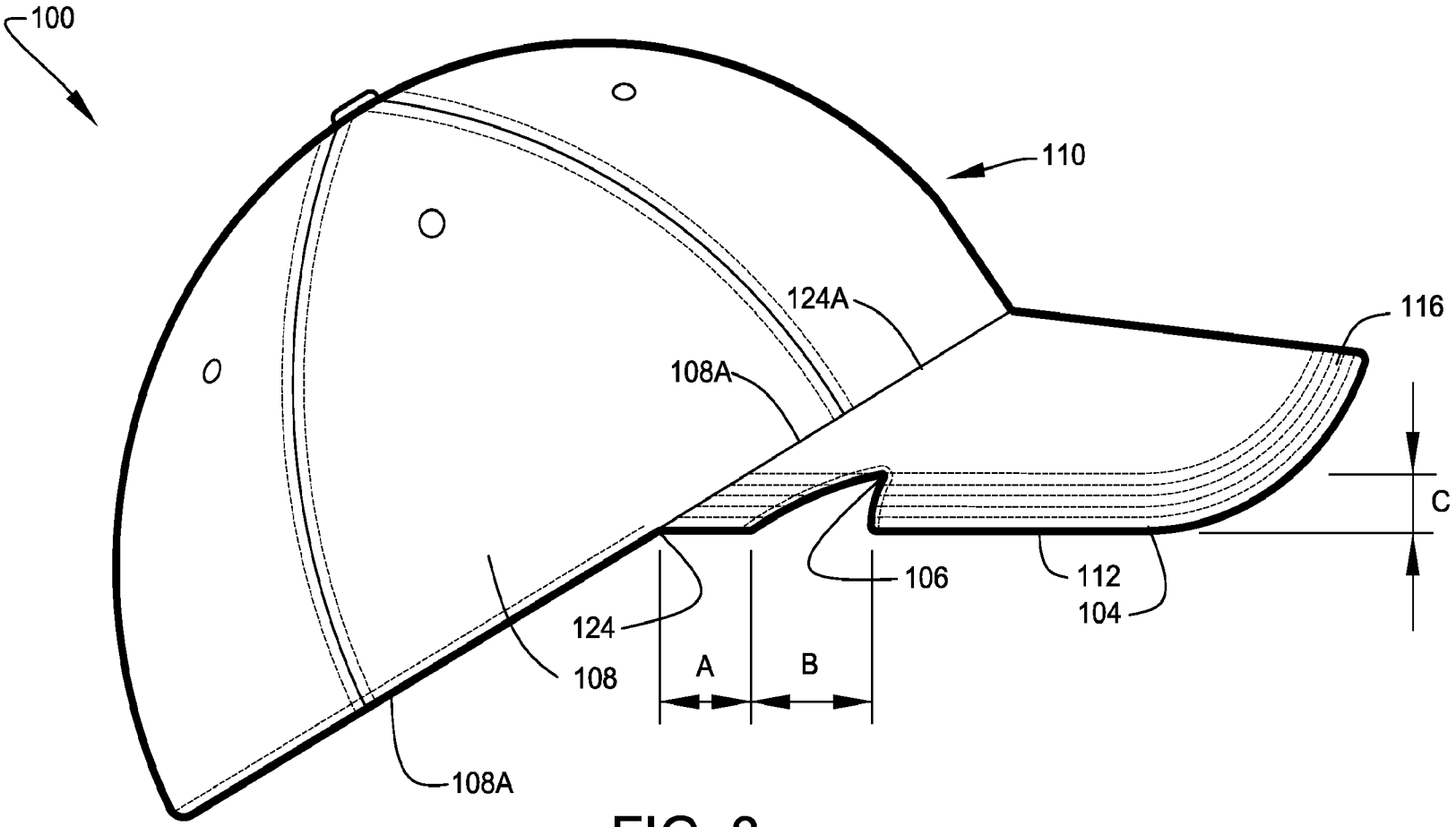
FIG. 3 shows a side view, illustrating the billed hat of the hat system, according to the preferred embodiment of FIG. 1.

FIG. 1 shows side view, illustrating a billed hat 110 of the hat system 100 in use by a hat wearer 102, according to a preferred embodiment of the present invention. FIG. 2 shows a top view, illustrating the billed hat 110, according to the preferred embodiment of FIG. 1. FIG. 3 shows a side view, illustrating the billed hat 110 of the hat system 100, according to the preferred embodiment of FIG. 1.

Hat system 100 preferably comprises at least one billed hat 110 comprising at least one hat bill 104 (the term hat bill 104 also referring herein to the terms hat visor and/or hat brim), wearable by at least one hat wearer 102, preferably comprising at least two bill cutouts 106, in which at least one bill cutout 106 is made along each respective left side 112 and right side 114 of the periphery 116 of hat bill 104, preferably from edge 118 towards center 120 of hat bill 104, as shown. Upon reading this specification, those with ordinary skill in the art will now appreciate that, under appropriate circumstances, considering such issues as design preference, user preferences, marketing preferences, cost, structural requirements, available materials, technological advances, etc., other cutout arrangements such as, for example, saw-tooth cutouts, multiple cutout locations, slots, serpentine cutouts, distressed-edge cutouts, etc., may suffice.

For reference with respect to FIG. 1, FIG. 2 and FIG. 3, hat crown 108 comprises a bottom edge 108A configured to surround the circumference of the head of hat wearer 102, when billed hat 110 is worn, as shown in FIG. 1 and FIG. 2. Bottom edge 108A is located at the lowest boundary of hat crown 108, as shown in FIG. 1 and FIG. 2. Hat bill 104 and hat crown 108 attach along a forward portion of bottom edge 108A at bill-crown joint 124A, as shown. Bill-crown joint 124A comprises a curved line seam with two endpoints referenced as junction 124 (as best shown in FIG. 2) on opposite sides of billed hat 110 and near each temple of hat wearer 102 (as best shown in FIG. 1), when billed hat 110 is worn. Bill-crown joint 124A is in front of the forehead of hat wearer 102, when billed hat 110 is worn in a forward manner (with the bill forward over the face of hat wearer 102) (as best shown in FIG. 1). Preferably, bill cutouts 106 comprise at least one incision 122, preferably cut along about a curved line on hat bill 104, preferably resembling a "shark fin" shape (as best shown in FIG. 2). The "shark fin" shape incision 122 preferably is situate about three quarters of an inch from junction 124 between hat bill 104 and hat crown 108 (as best shown by dimension A in FIG. 3). The bill cutout 106 preferably spans a width of about one inch (as best shown by dimension B in FIG. 3) preferably coming to about a point. Bill cutout 106 preferably transverses hat bill 104 and preferably spans a height of approximately nine-sixteenths of an inch (as best shown by dimension C in FIG. 3).

Bill cutouts 106 (at least embodying herein wherein such headwear-brim means comprises accommodator means for accommodating at least one portion of the eyewear rims in the at least one co-location) preferably comprise a symmetrical arrangement, preferably mirrored on each respective left side 112 and right side 114, preferably capable of providing clearance for typical symmetrical left and right eyewear frames, as shown. It is noted that the exact dimensions and shape of bill cutouts 106 may vary depending on the particular style of the hat, in which bill curvature may vary, and may also vary depending on the particular eyewear, so as to provide a system capable of accommodating essentially any billed hat/eyewear combination. Upon reading this specification, those with ordinary skill in the art will now appreciate that, under appropriate circumstances, considering such issues as cost, user preference, intended use, hat design, eyewear design, etc., other bill cutout shapes and geometries, such as, for example, slit cutouts, round cutouts, asymmetrical cutouts, multiple cutouts, distressed-edge cutouts, etc., may suffice. Further, upon reading this specification, those with ordinary skill in the art will now appreciate that, under appropriate circumstances, considering such issues as design preference, user preferences, marketing preferences, cost, structural requirements, available materials, technological advances, etc., other bill cutout arrangements such as, for example, cutouts coupled with any type of semi-firm and/or semi-flexible material situated around the periphery of the notch to provide further accommodation for the rim/brim of the eyeglasses or sunglasses, etc., may suffice.

As shown in FIG. 1, hat wearer 102 preferably is able to fully pull down hat bill 104 over the forehead while contemporaneously wearing eyewear 130, preferably as a result of the physical clearance provided by the geometry of bill cutouts 106, preferably comprising at least the symmetrical arrangement described herein and as shown. The above arrangement at least embodies herein wherein, when the at least one user is contemporaneously wearing such headwear-brim means and the at least one portion of the eyewear rims, such contemporaneous wearing is accommodated.

Preferably, potential interferences (between eyewear 130, particularly those involving eyewear rims 132, and hat bill 104) have thus been eliminated in the preferred use of hat system 100 to pull hat bill 104 (visor) low over the forehead and closer to the lowest horizon of eye-sight, as shown (this arrangement at least embodies herein headwear-brim means for assisting shade-cover to at least one portion of at least one face of the at least one user).

In use, hat system 100 preferably is configured to provide a means for accommodating user-selectable eyewear such as prescription eyeglasses, sunglasses, and fashion eyewear. At present, many billed hats/visor-comprising hats such as baseball-style hats, and other brim and billed hats, cannot be pulled down fully by the user while wearing eyeglasses due to physical interferences between the hat visor or hat brims and such eyewear rims and/or lenses (at least embodying herein wherein without such accommodator means, such headwear-brim means would interfere with the contemporaneous wearing of the eyewear rims). The preferred embodiments of the present hat system 100 are designed to reduce and/or eliminate physical interferences between hat bills (visors, etc) 104 and eyewear rims 132 by the introduction of strategic hat bill cutouts 106 along periphery 116 of the hat bill 104 as a means for providing physical clearance for user-chosen eyewear. Users of the preferred hat system 100 may then pull down their hat to a lower position (than previously available without the present invention arrangements) while wearing eyewear in order to achieve optimal comfort and facial shading from sun and bright lights.

Preferably, users/wearers of the preferred hat system 100 may also take advantage of bill cutouts 106 as a means to secure eyewear on the face during sports, or other moments of high activity. Preferably, bill cutouts 106, when placed as described herein and shown, comprise at least one restrainer element 140 to restrain eyewear 130 by friction of eyewear rims 132 along the combined periphery of hat bill cutouts 106, as shown. The above described arrangement at least embodies herein wherein such at least one accommodator comprises restrainer means for restraining at least one portion of the at least one eyewear rims. Preferably, the combination of two bill cutouts 106, in which at least one cutout 106 is made along each respective left side 112 and right side 114 of periphery 116 of hat bill 104 provide at least two restrainer elements 140 which preferably comprise at least two friction-resister elements to assist restraint of the eyewear rims by friction resistance (of the hat material against the eyewear rims) along at least two points along the eyewear rims when the eyewear is worn and placed as shown and described herein, particularly the contemporaneous wearing of the eyewear rims 132 and hat bill/visor 104, as shown.

Wearers preferably may also enjoy unique design elements provided by bill cutouts 106, preferably such as, for example, the shark fin design, as shown.

Upon reading this specification, those with ordinary skill in the art will now appreciate that, under appropriate circumstances, considering such issues as cost, user preference, intended use, etc., other billed hats such as, for example, tennis visors, sun hats, wide-brimmed hats, billed knit hats, distressed brim hats, etc., may suffice.

Figure 4:
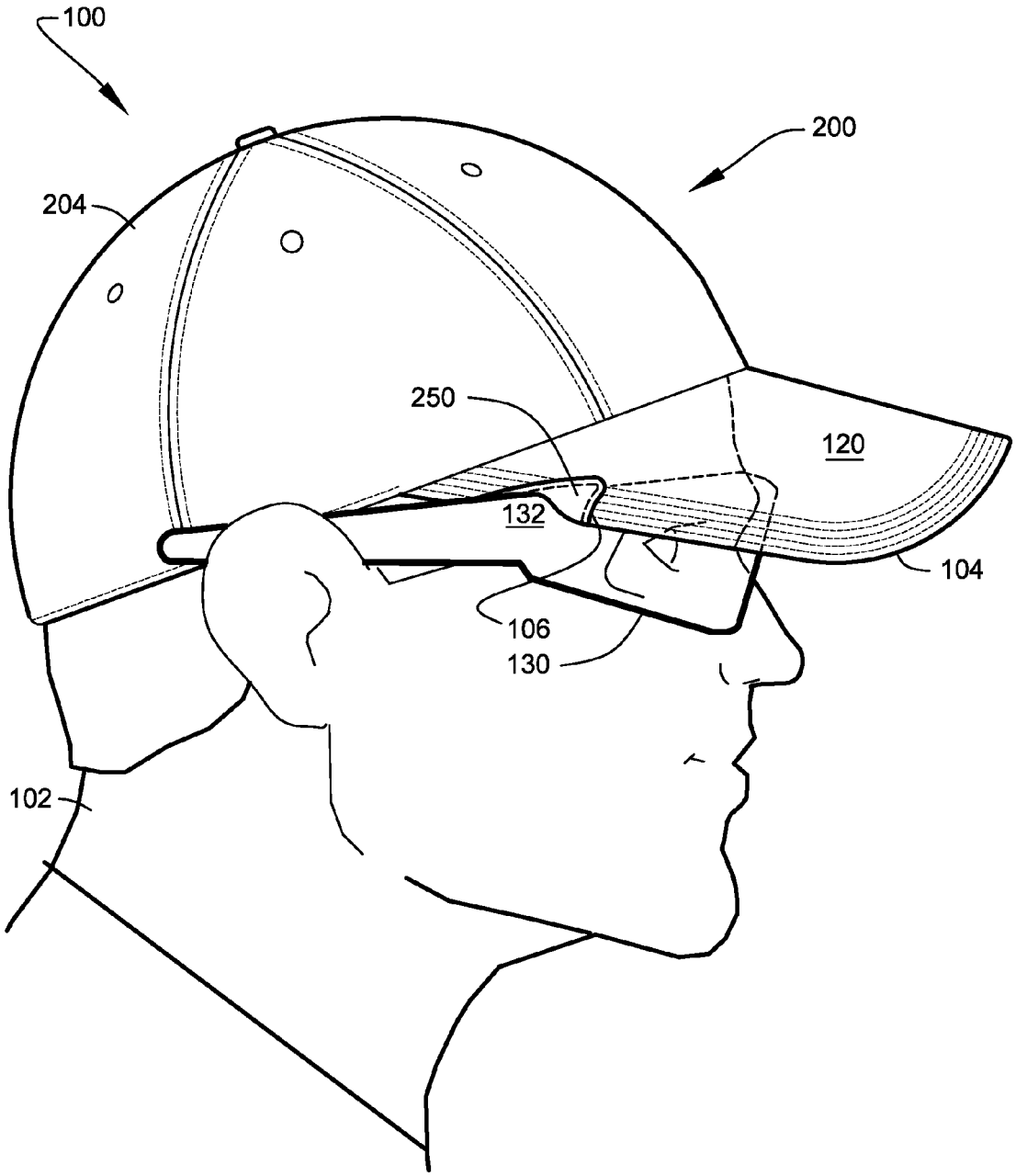
FIG. 4 shows a side view, illustrating another billed hat of the hat system in use by a hat wearer, according to another preferred embodiment of the present invention.
Figure 5:
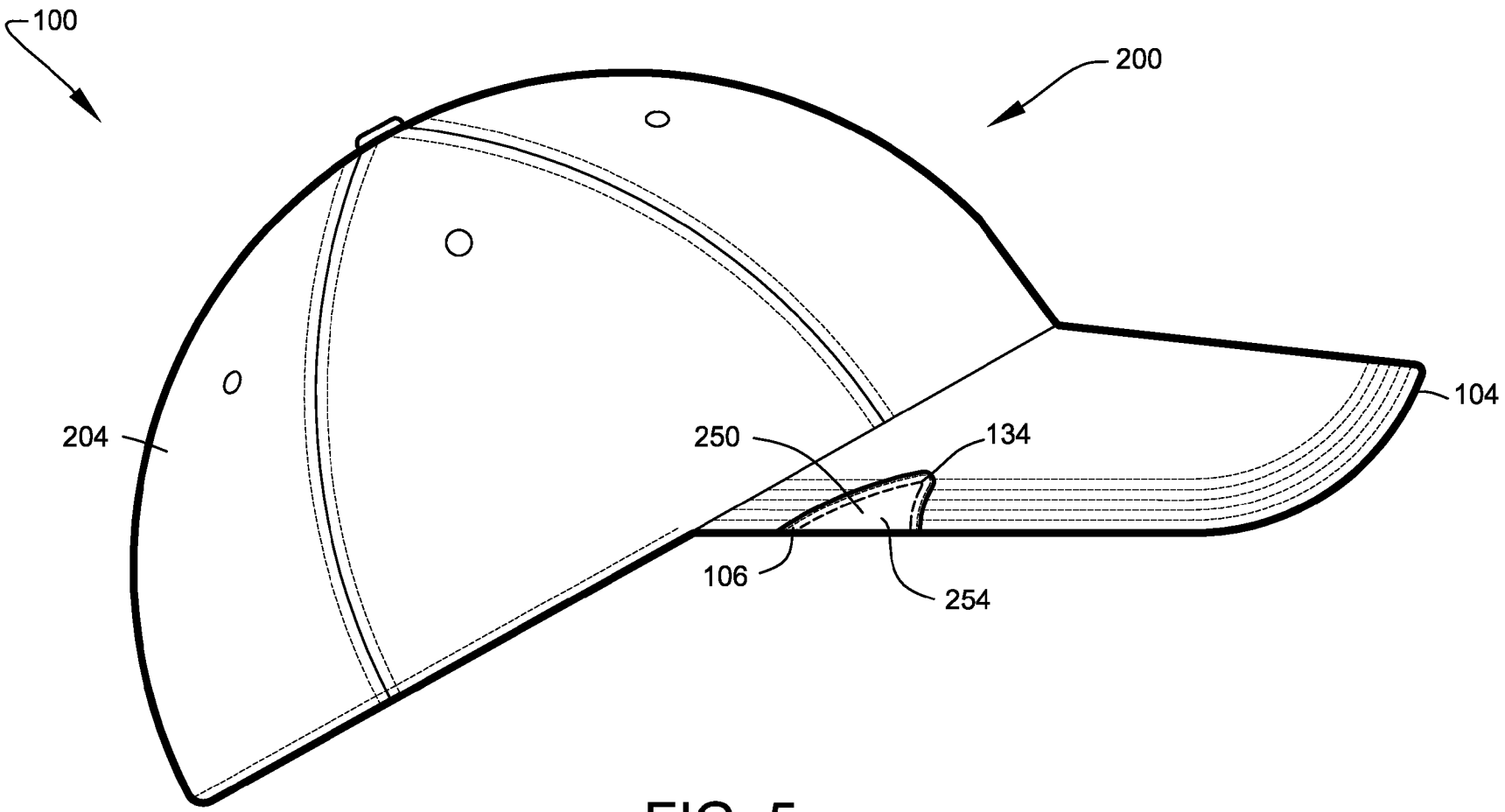
FIG. 5 shows a side view, illustrating the billed hat of FIG. 4, partially in section, according to the preferred embodiment of FIG. 4.

FIG. 4 shows a side view, illustrating another billed hat 204 of the hat system 100 in use by a hat wearer 102, according to another preferred embodiment 200 of the present invention. FIG. 5 shows a side view, illustrating the billed hat 204 of FIG. 4, partially in section, according to the preferred embodiment 200 of FIG. 4.

Embodiment 200 preferably comprises all the features of hat system 100, with the preferred addition of at least one fabric cover 250, preferably an elastic material, preferably an elastic "stretch" fabric that preferably at least covers the at least one bill cutout 106. Preferred fabric compositions for fabric cover 250 preferably include any stretchable, durable, and snag resistant fabric such as, for example, spandex and lycra. Upon reading this specification, those with ordinary skill in the art will now appreciate that, under appropriate circumstances, considering such issues as design preference, user preferences, marketing preferences, cost, structural requirements, available materials, technological advances, etc., other material arrangements such as, for example, other stretchable materials, other stretchable hat portions that would provide room for the eyewear rims as described herein, stretchable hat brim materials, etc., may suffice.

Embodiment 200 preferably provides at least visually masking of bill cutouts 106, preventing loss of shade, particularly when embodiment 200 is worn in the absence of eyewear, and visually appearing like a "normal" brim/visor when worn in a normal manner (not pulled down low, as shown).

Fabric cover 250 preferably is at least a double-thick-fabric covering to cover and assist camouflage of bill cutout 106. Upon reading this specification, those with ordinary skill in the art will now appreciate that, under appropriate circumstances, considering such issues as design preference, user preferences, marketing preferences, cost, structural requirements, available materials, technological advances, etc., other covering arrangements such as, for example, single layer, cross-layered, upper and lower cutout layering (above the bill cutout 106 and below the bill cutout 106 opening), etc., may suffice.

Preferably, fabric cover 250 at least covers both left and right side bill cutouts 106. Preferably, fabric cover 250 slightly overlaps opening 254 of bill cutout 106 by at least about one-sixteenth to about two inches. Fabric cover 250 preferably is sewn into hat bill 104 along at least cutout edge 134. Fabric cover 250 preferably camouflages bill cutout 106, so it is difficult to "see" bill cutouts 106, as shown (this arrangement at least embodies herein further comprising camouflage element means for camouflaging such accommodator means). Alternately preferably, fabric cover 250 preferably mirrors the preferred shark-fin shape of bill cutouts 106, as shown. Upon reading this specification, those with ordinary skill in the art will now appreciate that, under appropriate circumstances, considering such issues as design preference, user preferences, marketing preferences, cost, structural requirements, available materials, technological advances, etc., other camouflage arrangements such as, for example, use of Logo's, Trademarks, colors, patterns, materials, light-reflecting materials, light-absorbing materials, etc., may suffice.

Further, upon reading this specification, those with ordinary skill in the art will now appreciate that, under appropriate circumstances, considering such issues as cost, user preference, intended use, etc., other fabric covering geometries and designs, including promotional images, which may or may not outline the underlying shape of the cutout, etc., may suffice. Further, upon reading this specification, those with ordinary skill in the art will now appreciate that, under appropriate circumstances, considering such issues as design preference, user preferences, marketing preferences, cost, structural requirements, available materials, technological advances, etc., other bill cutout arrangements such as, for example, cutouts coupled with any type of semi-firm and/or semi-flexible material situated around the periphery of the notch to provide further accommodation for the rim/brim of the eyeglasses or sunglasses, etc., may suffice.

Figure 6:
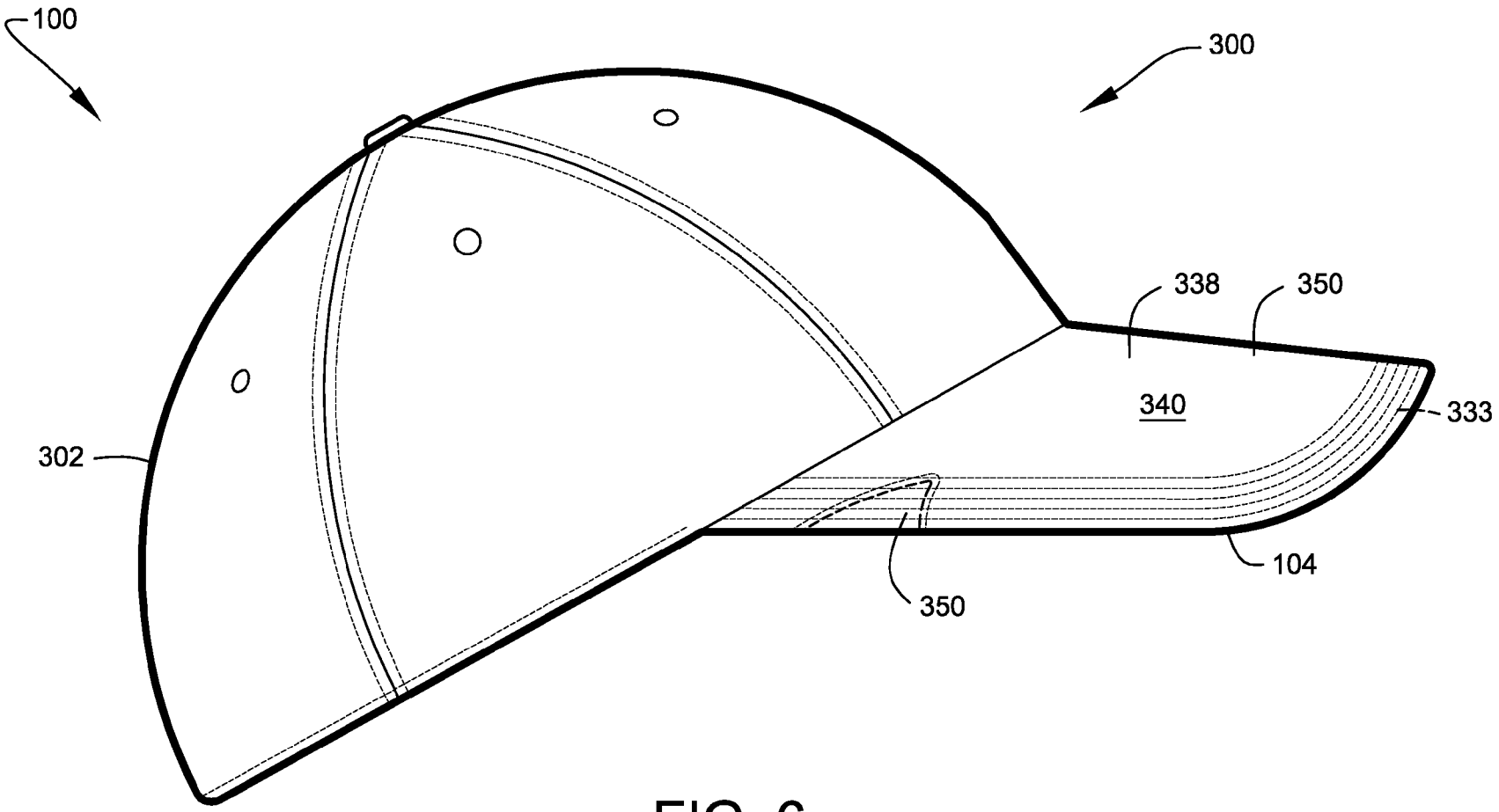
FIG. 6 shows a side view, illustrating another billed hat of hat system with bill cutout and fabric covering, according to another preferred embodiment of the present invention.

FIG. 6 shows a side view, illustrating another billed hat 302 of hat system 100 with bill cutout 106 (previously illustrated) and covering 350, according to another preferred embodiment 300 of the present invention. Preferred embodiment 300 preferably comprises at least one covering 350, preferably at least one fabric covering 338, which preferably covers at least the entire upper surface 340 of hat bill 104 (visor), such that covering 350 camouflages bill cutouts 106, as shown. Further, covering 350 preferably camouflages textural discontinuity between covering 350 and the underlying bill surface 333, such as, for example, stitching rows, etc, as shown.

Covering 350 preferably is folded over hat bill 104 and sewn such that any stitching or seams along the periphery preferably are hidden or only visible underneath hat bill 104 and preferably hidden from a top view, as shown. Alternately preferably, stitching and/or seams may be utilized on top of hat bill 104 for both attaching covering 350 and for decorative/design elements. Upon reading this specification, those with ordinary skill in the art will now appreciate that, under appropriate circumstances, considering such issues as design preference, user preferences, marketing preferences, cost, structural requirements, available materials, technological advances, etc., other covering arrangements such as, for example, covering both on the upper bill surface and lower bill surface, covering only the lower bill surface, other design elements, other structural functions, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system, relating to permitting at least one wearer of headwear to contemporaneously wear headwear bills and eyewear rims occupying at least one co-location, comprising:

a) a headwear-crown structured and arranged to engage a head of the at least one wearer to hold the headwear on the head;

b) wherein said headwear-crown comprises a bottom edge configured to surround the circumference of the head; and c) at least one headwear-bill structured and arranged to assist shade-cover to at least one portion of the face of the at least one wearer;

d) wherein said headwear-crown and said at least one headwear-bill attach along a bill-crown joint comprising, a curved-line seam configured to traverse in front of the forehead of the at least one wearer between two points each located on opposite sides of the headwear near opposite temples of the at least one wearer, when worn in a forward manner;

e) wherein said bill-crown joint is located along a front portion of said bottom edge;

f) wherein, when worn in a forward manner, said headwear-crown consists of all portions of the headwear behind said bill-crown joint and said at least one headwear-bill consists of all portions of the headwear forward of said bill-crown joint;

g) wherein said at least one headwear-bill extends away from said headwear-crown and away from the head, when worn;

h) wherein said at least one headwear-bill comprises at least one accommodator structured and arranged to accommodate at least one portion of the eyewear rims in the at least one co-location;

i) wherein said at least one accommodator is on an edge of said at least one headwear-bill;

j) wherein said at least one accommodator comprises at least one cutout;

k) wherein, when the at least one wearer is contemporaneously wearing said at least one headwear-bill and the at least one portion of the eyewear rims, such contemporaneous wearing is accommodated; and l) wherein without said at least one accommodator said at least one headwear-bill would interfere with the contemporaneous wearing of the eyewear rims.

2. The system according to claim 1 wherein said at least one accommodator comprises at least one restrainer structured and arranged to restrain at least one portion of the eyewear rims.

3. The system according to claim 2 wherein said at least one restrainer is structured and arranged to assist maintaining the eyewear rims on the wearer during wearer physical activity.

4. The system according to claim 2 wherein said at least one restrainer comprises at least two friction-resister elements structured and arranged to assist restraint of the eyewear rims by friction resistance along at least two points along the eyewear rims.

5. The system according to claim 1 further comprising at least one camouflage element structured and arranged to camouflage said at least one accommodator.

6. The system according to claim 1 wherein said at least one accommodator comprises at least two cutouts, situate opposed along at least one periphery of said at least one headwear-bill, structured and arranged to accommodate at least opposed eyewear rim portions.

7. The system according to claim 6 wherein each of said at least two cutouts resemble at least a shark fin geometry.

8. The system according to claim 6 further comprising at least one camouflage element structured and arranged to at least camouflage said at least two cutouts.

9. The system according to claim 8 wherein each of said at least two cutouts resemble at least a shark fin geometry.

10. The system according to claim 9 wherein:

a) said at least one headwear-bill comprises an upper portion and a lower portion; and b) said at least one camouflage element covers at least said upper portion of said at least one headwear-bill.

* * * * *